United States Patent [19]

Sedwick

[11] Patent Number: 4,518,115

[45] Date of Patent: May 21, 1985

[54] INTEGRAL FLAP-CUT HANDLE FOR A CARTON

[75] Inventor: William E. Sedwick, Cincinnati, Ohio

[73] Assignee: The Procter & Gamble Company, Cincinnati, Ohio

[21] Appl. No.: 461,078

[22] Filed: Jan. 26, 1983

Related U.S. Application Data

[63] Continuation of Ser. No. 276,732, Jun. 24, 1981, abandoned.

[51] Int. Cl.[3] ..... B65D 5/46

[52] U.S. Cl. ..... 229/52 B; 206/141

[58] Field of Search ..... 229/52 B, 52 BC, DIG. 6; 206/141

[56] References Cited

U.S. PATENT DOCUMENTS

| | | | |
|---|---|---|---|
| 2,693,310 | 11/1954 | Stopper | 229/52 B |
| 4,109,849 | 8/1978 | Wood | 229/52 B |
| 4,134,534 | 1/1979 | Scott | 229/52 B |
| 4,140,267 | 2/1979 | Scott | 229/52 B |

FOREIGN PATENT DOCUMENTS

| | | | |
|---|---|---|---|
| 2459705 | 7/1976 | Fed. Rep. of Germany | 229/52 B |
| 269963 | 11/1950 | Switzerland | 229/52 B |
| 279495 | 3/1952 | Switzerland | 229/52 B |
| 500786 | 2/1939 | United Kingdom | 229/52 B |
| 598170 | 2/1948 | United Kingdom | 229/52 B |

*Primary Examiner*—William Price
*Assistant Examiner*—Gary E. Elkins
*Attorney, Agent, or Firm*—John M. Pollaro; Fredrick H. Braun; Richard C. Witte

[57] ABSTRACT

An integral handle is provided for a carton having opposed pairs of side walls, a bottom wall and a top wall comprising at least first and second substantially identical overlapping flaps hingedly connected to the upper edges of one of the opposed pairs of side walls. The handle comprises first and second handle elements. The first handle element is die cut from the upper portion of the first flap and is of a length less than the width of the first flap. The first handle element has a finger receiving aperture and is pivotal about score line hinges formed in the first flap. The second handle element is of greater length than the first handle element and comprises the entire upper portion of the second flap as defined by a score line hinge extending the full width of the second flap in parallel spaced relationship to the upper edge thereof and about which the second handle element is pivotal. The second flap has at least one finger receiving aperture alignable with the aperture of the first handle element. The first and second flaps are folded inwardly to form the top wall of the carton with portions of the second flap overlapping and secured to portions of the first flap and the first and second handle elements secured together to form the integral handle.

2 Claims, 8 Drawing Figures

INTEGRAL FLAP-CUT HANDLE FOR A CARTON

This is a continuation of application Ser. No. 276,732, filed June 24, 1981, now abandoned.

TECHNICAL FIELD

The invention relates to an integral flap-cut handle for a carton and more particularly to such a handle made up of first and second handle elements formed from opposed top-forming flaps of the carton, the first handle element being of a length less than the width of its respective flap and the second handle element being of a length longer than the first handle element and substantially equivalent to the full width of its respective flap.

BACKGROUND ART

While not intended to be so limited, the handle construction of the present invention is particularly suited for use with large, bulky cartons.

In recent times it has been common practice to package numerous types of products in large, bulky, convenience packs. A non-limiting example is the packaging of disposable diapers in large, rectangular, cartonboard cartons. The cartons are of such size that some type of handle means is desirable to carry the cartons conveniently. Initially, it was prior art practice to provide wholly separate handle means affixed in some appropriate manner to the top wall of the carton. The application of such separate handle means, however, was an expensive and time consuming step. As a result, prior art workers turned their attention to the provision of some sort of integral handle means.

While many types of integral handles have been devised, for the most part, prior art workers have taken one of two basic approaches to the problem. A first approach is to provide a handle made up of two handle elements affixed together. The handle elements constitute the entire uppermost portions of the major or outside top wall forming flaps. The handle elements are defined by score line hinges extending the full width of the flaps and in parallel spaced relationship to the upper edges of the flaps, the handle elements being provided with corresponding finger-receiving apertures. Such a handle element is shown, for example, in the cartons of U.S. Pat. No. 2,680,556, issued in the name of G. C. Currie, June 8, 1954; U.S. Pat. No. 3,430,845, issued in the names of R. Susuki and H. Hoshi, Mar. 4, 1969; and U.S. Pat. No. 4,193,535, issued in the name of H. J. Griffitti, Mar. 18, 1980. Such a handle element tends to resist torque and twisting of the carton during handling, but the handle elements of the major flaps are the only portions of the major flaps joined together and the major flaps from which the handle element are formed tend to tent or raise up along the score line hinges.

The second primary approach again provided an integral handle constituting handle elements formed from the major top wall forming flaps. In this instance, however, the handle elements were die cut from the major flaps, having a length less than the full width of the flaps. Again, each handle element was provided with a finger-receiving aperture. Such an integral handle construction is illustrated, for example, in U.S. Pat. No. 3,416,719, issued to the name of N. J. Pilger, Dec. 17, 1968; U.S. Pat. No. 4,134,534 in the names of R. G. Scott and L. S. Wysocki, issued Jan. 16, 1979; U.S. Pat. No. 4,140,267, issued in the names of R. G. Scott and L. S. Wysocki, Feb. 20, 1979; and U.S. Pat. No. 4,195,765, issued in the names of H. I. Roccaforte, J. Hanko and J. F. Schillinger, Apr. 1, 1980. This construction has the advantage that portions of the major flaps, in addition to the handle elements, may be overlapped and glued or otherwise affixed together. However, since the die cut handles do not have a length substantially equivalent to the full width of the major flaps from which they are formed, they are less resistant to torque and twisting of the carton during handling and they do have a tendency to tear at the ends of the die cuts adjacent the base portions of the handle elements. To preclude this tearing, various types of reinforcing, including the application of tape or the like, have been used.

The present invention is based upon the discovery that if a handle is comprised of two handle elements formed from the major top wall flaps, and if one of the handle elements is die cut and of a length less than the width of its respective flap and the other handle element extends the full width of its respective flap, the advantages of both of the previously described approaches can be achieved while the disadvantages of the prior art approaches are minimized. The handle of the present invention is simple and economical to manufacture. Furthermore, the handle is more resistant to tenting, torquing and tearing than the above described prior art handles. Prior to use, the handle may be folded flat against one of the top forming flaps and adhesively tacked thereto. Additional reinforcement against tenting may be accomplished by a single piece of tape, as will be described hereinafter.

DISCLOSURE OF THE INVENTION

According to the invention there is provided an integral handle for a cartonboard carton of the type having opposed pairs of side walls, a bottom wall and a top wall. The top wall comprises at least first and second substantially identical overlapping flaps hingedly connected to the upper edges of one of the pairs of opposed side walls.

The handle comprises first and second handle elements. The first handle element is of inverted U-shaped configuration, die cut from the upper portion of the first flap by a pair of spaced cuts extending inwardly from the top edge of the first flap and by an inverted U-shaped cut having a base portion spaced inwardly from the top edge of the first flap and leg portions located between and spaced from the pair of inwardly extending cuts. At its base portions, the first handle element is provided with score line hinges so that it may be pivoted out of the plane of the first flap, the inverted U-shaped cut defining a finger receiving aperture. The first handle element is of a length less than the width of the first flap.

The second handle element is of greater length than the first handle element and comprises the entire upper portion of the second flap. The second handle element is defined by score line hinges and at least one finger aperture in parallel spaced relationship to the upper edge of the second flap and about which the second handle element is pivotable out of the plane of the second flap. The second handle element is provided with at least one die cut finger receiving aperture, alignable with the finger receiving aperture of the first handle element.

The first and second flaps are folded inwardly toward each other to form the top wall of the carton. Portions of the second flap overlap and are affixed to portions of the first flap by gluing or other appropriate means.

Similarly, the first and second handle elements are glued or otherwise joined together to form the integral handle.

DETAILED DESCRIPTION OF THE INVENTION

Figure 6:
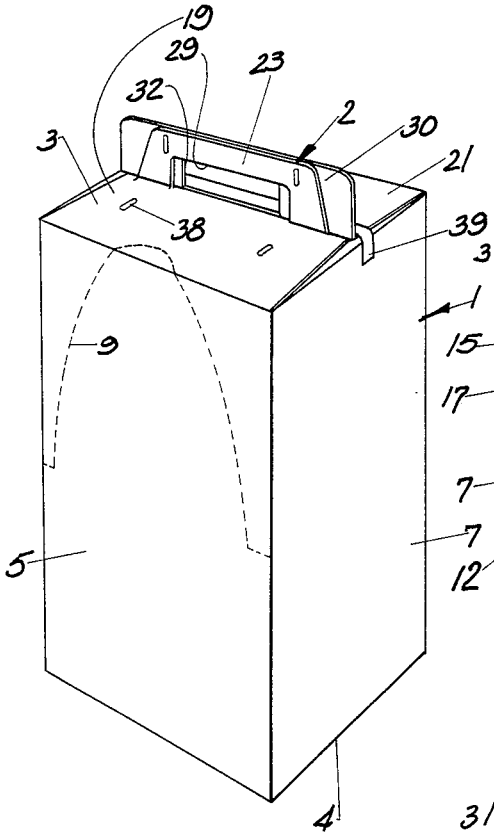
FIG. 6 is a perspective view illustrating the fully formed carton in its entirety and the integral handle of the present invention in its upright position for use.

FIG. 6 illustrates an exemplary carton and the application of the integral handle of the present invention thereto. The carton is generally indicated at 1 and the integral handle is generally indicated at 2. For purposes of this exemplary showing, the carton is illustrated as being a large convenience pack for disposable diapers. The carton 1 has a top wall 3, a bottom wall 4 and opposed pairs of side walls 5-6 and 7-8 (see also FIG. 1). The top wall 3 and side wall 5 may be provided with a tear line 9 by which an access opening can be formed in the carton.

Figure 1:
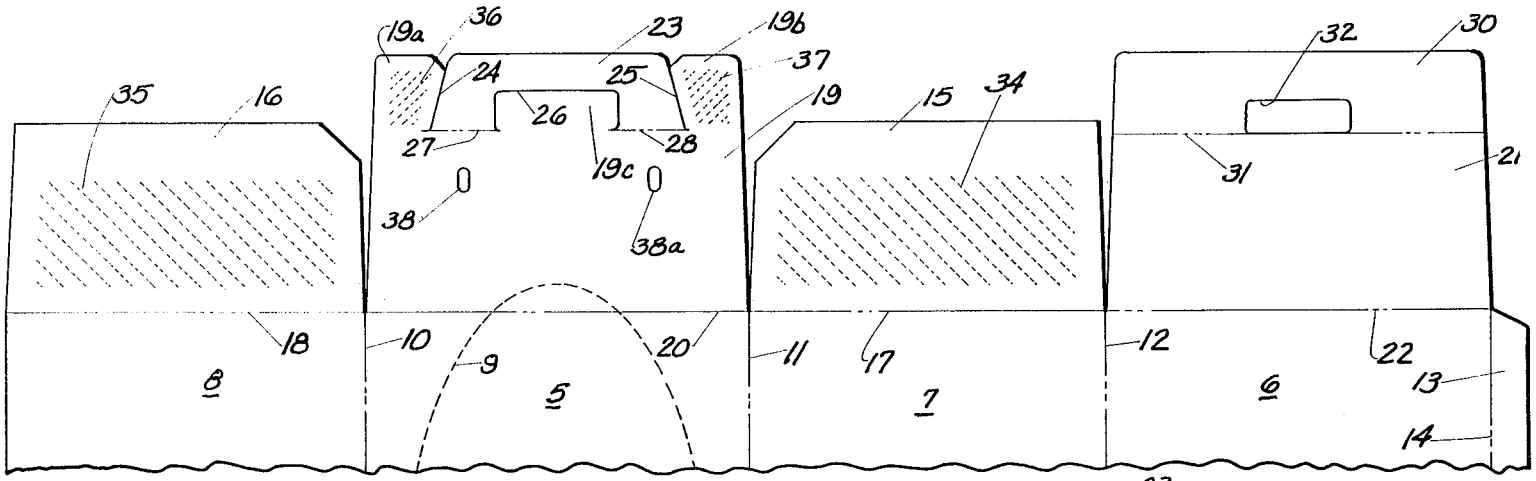
FIG. 1 is a fragmentary elevational view of the exterior surface of a carton blank incorporating the integral handle of the present invention.

FIG. 1 illustrates the blank from which the carton 1 is made. The opposed pairs of side walls 5-6 and 7-8 are shown. Side walls 5 and 8 are joined by a vertical scored hinge or fold line 10. Similarly, side walls 5 and 7 are joined by a vertical scored fold line 11 and side walls 6 and 7 are joined by a vertical scored fold line 12. Along its free vertical edge, the side wall 6 is provided with a vertical flap 13, connected thereto by a vertical scored fold line 14. The vertical flap 13 is adapted to be affixed by adhesive or other means to free edge of side wall 8, on either the inside or outside surface thereof, to form the side walls into a rectangular configuration (see FIG. 3).

It will be understood by one skilled in the art that the side walls 5 through 8 will have appropriate flaps (not shown), joined thereto by scored hinge lines, to make up the bottom wall 4. The nature and construction of bottom wall 4 does not constitute a part of the present invention.

The opposed pair of side walls 7 and 8 carry at their upper ends minor flaps 15 and 16. Minor flaps 15 and 16 are joined to their respective side walls by scored fold lines 17 and 18. Minor flaps 15 and 16 are substantially mirror images of each other and are the first flaps to be folded inwardly in the formation of top wall 3.

Side wall 5 carries at its upper end major flap 19, joined thereto by a scored fold line 20. In similar fashion, side wall 6 carries a major flap 21 secured thereto by a scored fold line 22. Major flaps 19 and 21 constitute the outside flaps of top wall 3 and are folded inwardly over minor flaps 15 and 16, as will be described hereinafter.

The integral handle of the present invention comprises two handle elements, the first of which is formed in major flap 19. This first handle element is indicated at 23. Handle element 23 is die cut and is defined by cuts 24 and 25 extending inwardly from the top edge of flap 19 and diverging slightly, as shown in FIG. 1. The handle element 23 is further defined by an inverted U-shaped die cut 26 having a base portion parallel to the uppermost edge of flap 19 and inwardly extending leg portions located between and spaced from cuts 24 and 25. At its base portions, handle element 23 is provided with scored hinge lines 27 and 28, by which handle element 23 may be bent upwardly out of the plane of flap 19. When handle element 23 is bent upwardly out of the plane of flap 19 along scored hinge lines 27 and 28, the inverted U-shaped cut 26 defines a finger receiving opening 29 (see FIG. 6) in handle element 23. At the same time, portions **19*a*, 19*b* and 19*c* of flap 19 remain in the plane of flap 19 and extend beyond upright handle element 23. Flap portions 19*a* through 19*c* are intended to be overlapped by portions of flap 21** and adhered thereto, as will be described hereinafter.

As will be evident from FIG. 1, the flap 21 is substantially identical to the flap 19 in overall dimensions. The second handle element of the integral handle of the present invention is formed from flap 21. The second handle element is indicated at 30 and constitutes the entire upper portion of flap 21, defined by scored hinge line 31 which extends the full width of flap 21. The second handle element 30 may be bent upwardly out of the plane of flap 21 along scored hinge line 31. The second flap element is also provided with a die cut finger receiving opening 32 corresponding to the finger receiving opening 29 of first handle element 23. The aperture or opening 32 is substantially rectangular, with rounded corners.

Figure 2:
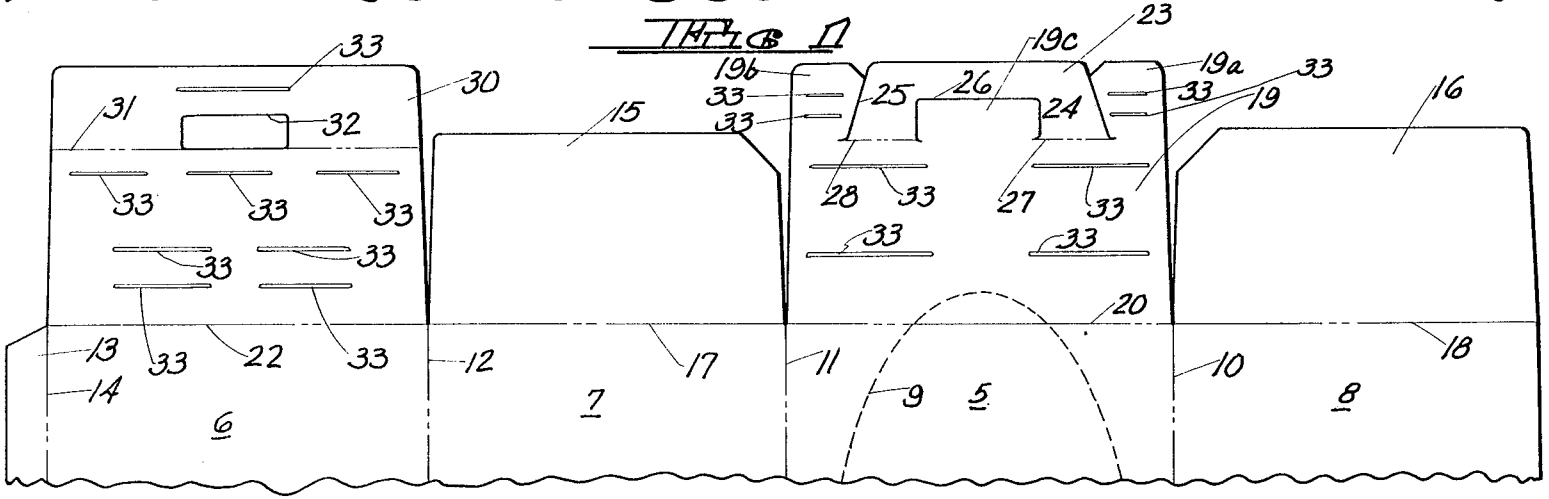
FIG. 2 is a fragmentary elevational view of the inside surface of the carton blank of FIG. 1.

The minor flaps 15 and 16 and the major flaps 19 and 21 are folded inwardly and adhered to each other (as are handle elements 23 and 30) by any appropriate means well known in the art. In FIG. 2 the inside surface of the blank of FIG. 1 is illustrated, like parts having been given like index numerals. For purposes of a complete disclosure, an exemplary hot melt glue pattern is illustrated on flaps 19 and 21 at 33.

Since major flaps 19 and 21 are to be folded down upon minor flaps 15 and 16, the minor flaps 15 and 16 may be provided with a pattern of small surface perforations or slits intended to serve as glue assists. Such glue assist patterns are shown at 34 and 35 on flaps 15 and 16. Glue assists of this type are well known in the art and enable the glue to partially penetrate the flaps for greater adherence. Glue assists patterns are shown at 36 and 37 on the portions **19*a* and 19*b* of flap 19. The portion 19*c*** may also be provided with similar glue assists (not shown).

Although not required, it is preferred that while the blank is in its flat, unfolded form, the handle element 23 be folded back upon flap 19 and tacked thereto. As will be evident hereinafter, this facilitates the final forming procedure of top wall 3, after the contents have been located within carton 1. To this end one or more small areas (which element 23 will overlie when folded back upon flap 19) are shallowly die cut so as to penetrate only the outermost surface of the cartonboard. For purposes of an exemplary showing, two small oval die cuts 38 and **38*a* are illustrated in FIG. 1. A drop of appropriate adhesive is located within the confines of the oval die cuts and handle element 23 is folded upon flap 19 and adhered thereto. The purpose of the shallow die cuts 38 and 38*a*** will be evident hereinafter.

Figure 3:
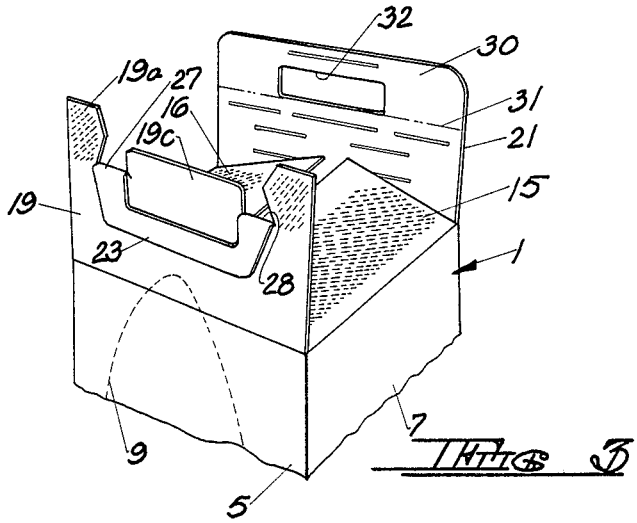
FIGS. 3 through 5 are fragmentary perspective views illustrating the forming of the carton and integral handle element from the blank of FIGS. 1 and 2.
Figure 4:
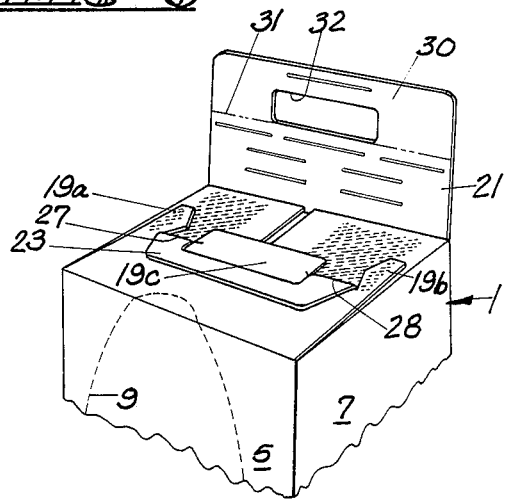
Figure 5:
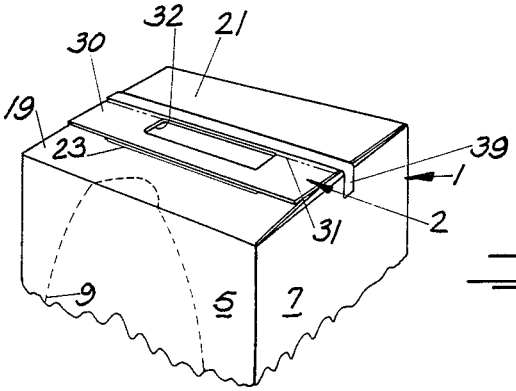

Reference is now made to FIGS. 3 through 5 wherein the steps of forming top wall 3 are illustrated. Turning first to FIG. 3, the carton 1 is shown in its folded and formed condition, the flap 13 having been affixed along the free edge of side wall 8 (see FIG. 1). As a first step, minor flaps 15 and 16 are folded inwardly. It will be noted in FIG. 3 that handle element 23 has been folded (along scored hinge lines 27 and 28) back upon panel 19 and adhered thereto.

The next step is shown in FIG. 4. In FIG. 4 major flap 19 has been folded down against minor flaps 15 and 16 and adhered thereto. It will be noted by one skilled in the art that portions 19*a* through 19*c* of flap 19 extend beyond the base portions of handle element 23.

The final step in the formation of top wall 3 is illustrated in FIG. 5. In this Figure, major flap 21 had been bent over and adhered to minor flaps 15 and 16, portions 19*a* through 19*c* and to handle element 23.

Returning to FIG. 1, the distance between fold line 20 and hinge lines 27 and 28 of major flap 19 is slightly greater than the distance between fold line 22 and hinge line 31 of flap 21. This will assure that when the flap 21 is folded and adhered to the flap 19, the hinge line 31 will properly overlie hinge lines 27 and 28 of flap 19 so that, when the carton handle is to be used, it is only necessary for the customer to pull upwardly on the integral handle 2 rupturing the glue tacks surrounded by the shallow die cuts 38 and 38*a*. This is shown in FIG. 6. The shallow die cuts 38 and 38*a* assure that when the tacks holding handle element 23 against flap 19 are ruptured, it will not tear portions of the surface of flap 19 beyond the confines of the shallow die cuts 38 and 38*a*.

When the handle 2 is in its initial folded condition (as shown in FIG. 5) it will be evident that the carton 1 can readily be stacked for purposes of transport or display on a shelf or the like. The advantages of the construction of the present invention will be apparent from FIG. 6. First of all, by virtue of the fact that handle element 23 is die cut from flap 19, the flap portions 19*a* through 19*c* remain to be bonded to minor flaps 15 and 16 as well as the other major flap 21. This, of course, makes for greater strength and reduces tenting. On the other hand, since handle element 30 extends the full width of major flap 21, it will tend to prevent torque and twisting of the integral handle 2 during manipulation. Furthermore, the fact that handle element 30 is full width and that handle element 23 is adhered thereto, will tend to preclude tear back of the base portions of handle element 23. As a further precaution against tenting, a single strip of tape can be laid along the width of major flap 21 near score line 31, with the ends of the tape extending downwardly along the adjacent opposed carton side walls. Such a piece of tape is illustrated at 39 in FIGS. 5 and 6.

Figure 7:
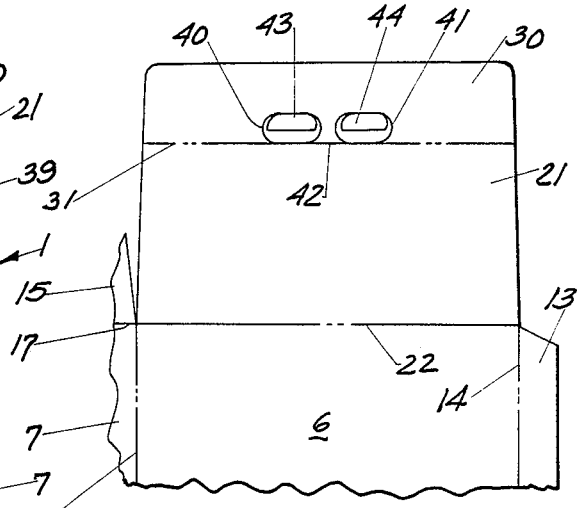
FIGS. 7 and 8 are fragmentary elevational views of the carton blank of FIG. 1, illustrating alternative types of finger receiving apertures formed in the second handle element.
Figure 8:
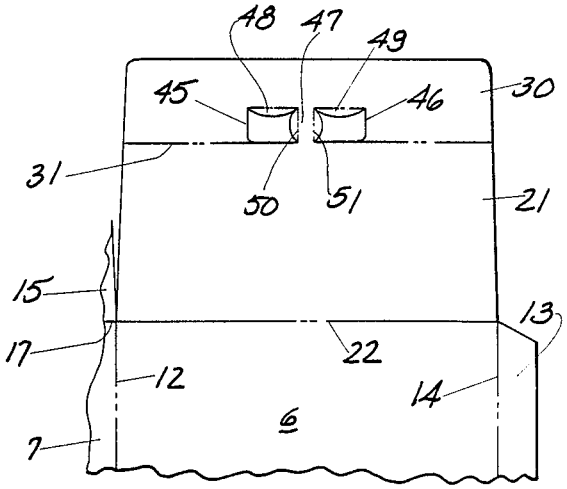

FIGS. 7 and 8 illustrate alternative embodiments of finger receiving apertures in handle element 30. In the embodiment of FIG. 7, the handle element 30 is provided with two die cut, finger-receiving openings 40 and 41 with an integral web portion 42 therebetween. Such an arrangement will tend to further strengthen handle element 30 and increase its ability to reduce torque and twisting of the integral handle. While the apertures 40 and 41 may constitute simple, elongated oval apertures, they may also be provided with integral comfort tabs. Such comfort tabs, well known in the art, are shown at 43 and 44 and are intended to be folded upwardly about handle element 23 when the handle elements are in the upright position shown in FIG. 6. It will be understood that such a comfort tab could be provided on handle element 30 of FIGS. 1 through 6.

Yet another arrangement of finger-receiving apertures is shown in FIG. 8. Here, a pair of substantially rectangular apertures 45 and 46 are provided with a web portion 47 located therebetween. In this instance, comfort tabs are again provided at 48 and 49, intended to be wrapped about handle element 23 when the integral handle 2 is in its upright position. An additional pair of comfort tabs 50 and 51 may be provided in association with web portion 47.

Modifications may be made in the invention, without departing from the spirit of it. For example, in addition to providing tape for added strength and tenting resistance, and in addition to modification of the finger-receiving apertures, the handle dimensions, carton dimensions, type of cartonboard used, glueing patterns and flap orientation can each or all be modified while staying well within the spirit of the invention.

What is claimed is:

1. An integral handle for a carton of the type having opposed pairs of side walls, a bottom wall, and a top wall, said top wall comprising at least first and second overlapping flaps hingedly connected to the upper edges of one of said opposed pairs of side walls, said handle comprising first and second handle elements, said first handle element having an inverted U-shaped configuration, said first handle element being die cut from the upper portion of said first flap by a pair of spaced cuts extending inwardly from the top edge of said first flap and by an inverted U-shaped cut having a base portion spaced inwardly from said top edge of said first flap and leg portions located between and spaced from said pair of inwardly extending cuts, said inverted U-shaped cut defining a finger-receiving aperture in said first handle element, said first handle element having a length less than the width of said first flap, said first handle element having a first handle element inside surface and being pivotable out of the plane of said first flap about score line hinges formed in said first flap and folded back upon said first flap, said second handle element being of greater length than said first handle element and comprising the entire width of the upper portion of said second flap as defined by score line hinges and at least one finger-receiving aperture in parallel spaced relationship to the upper edge thereof, said second handle element having a second handle element inside surface and being pivotable about said second flap score line hinges out of the plane of said second flap, said finger-receiving apertures of said first and second handle elements being in alignment when said handle elements are secured together, said first and second flaps being folded inwardly with portions of said second flap overlapping portions of said first flap, means for securing portions of said second flap to portions of said first flap and said second handle element inside surface to said first handle element inside surface.

2. The structure claimed in claim 1 including means for releasably tacking said first handle element to said first flap when said first handle element is folded back upon said first flap, said means comprising an oval die cut, said oval die cut being formed by shallowly die cutting an area of said first flap so as to penetrate only the outermost surface of said first flap, and adhesive located within the confines of said oval die cut.

* * * * *